US009735500B2

(12) United States Patent
Magana et al.

(10) Patent No.: US 9,735,500 B2
(45) Date of Patent: Aug. 15, 2017

(54) MAGNETIC CONNECTOR FOR A COMPUTING DEVICE

(75) Inventors: Giovanni Mata Magana, Palo Alto, CA (US); Richard Gioscia, Sunnyvale, CA (US); Philip Bryan, Sunnyvale, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/416,745

(22) PCT Filed: Jul. 31, 2012

(86) PCT No.: PCT/US2012/048986

§ 371 (c)(1),
(2), (4) Date: Jan. 23, 2015

(87) PCT Pub. No.: WO2014/021847

PCT Pub. Date: Feb. 6, 2014

(65) Prior Publication Data

US 2015/0194764 A1 Jul. 9, 2015

(51) Int. Cl.

| | |
|---|---|
| ***H01R 11/30*** | (2006.01) |
| ***H01R 13/62*** | (2006.01) |
| ***H01R 13/64*** | (2006.01) |
| ***H01R 13/642*** | (2006.01) |

(52) U.S. Cl.
CPC ..... *H01R 13/6205* (2013.01); *H01R 13/64* (2013.01); *H01R 13/642* (2013.01)

(58) Field of Classification Search
USPC ..... 439/39
See application file for complete search history.

(56) References Cited

U.S. PATENT DOCUMENTS

| | | | | |
|---|---|---|---|---|
| 4,004,298 | A | 1/1977 | Freed | |
| 5,812,356 | A | 9/1998 | O'Connor | |
| 7,351,066 | B2 * | 4/2008 | DiFonzo | H01R 13/641 439/39 |
| 7,566,224 | B2 * | 7/2009 | Wu | H01R 13/6205 439/39 |
| 7,607,920 | B1 * | 10/2009 | Chen | H01R 31/06 439/39 |

(Continued)

FOREIGN PATENT DOCUMENTS

| | | |
|---|---|---|
| CN | 102593636 A | 7/2012 |
| CN | 102625966 | 8/2012 |

(Continued)

OTHER PUBLICATIONS

International Search Report and Written Opinion received in PCT Application No. PCT/US2012/048986, mailed Mar. 29, 2013, 11pg.

(Continued)

*Primary Examiner* — Tho D Ta
(74) *Attorney, Agent, or Firm* — HP Patent Department

(57) ABSTRACT

A magnetic connector for a computing device is disclosed. The magnetic connector can include a housing. The housing includes an asymmetric shape, a connector interface including at least one contact element to carry at least one of data or power, and a magnetic component provided on the connector interface. The housing and the magnetic component are oriented to key the connector interface into proper alignment when mated with an opposing connector that includes at least two magnetic components of opposite polarity.

13 Claims, 9 Drawing Sheets

(56) References Cited

U.S. PATENT DOCUMENTS

| | | | | |
|---|---|---|---|---|
| 7,625,212 | B2 * | 12/2009 | Du | H01R 13/6205 439/39 |
| 7,775,801 | B2 * | 8/2010 | Shiff | H01R 13/6205 439/39 |
| 8,143,983 | B1 | 3/2012 | Lauder et al. | |
| 8,512,048 | B2 * | 8/2013 | Yasuoka | H01R 13/447 439/39 |
| 8,794,980 | B2 * | 8/2014 | McCormack | H01R 13/6205 439/39 |
| 2004/0209489 | A1 | 10/2004 | Clapper | |
| 2006/0084300 | A1 * | 4/2006 | Kowalski | A63H 33/046 439/100 |
| 2007/0072442 | A1 | 3/2007 | DiFonzo et al. | |
| 2008/0003841 | A1 | 1/2008 | Su et al. | |
| 2011/0143556 | A1 * | 6/2011 | Hsu | H01F 38/14 439/39 |
| 2011/0159706 | A1 * | 6/2011 | Wu | H01R 13/6205 439/39 |
| 2011/0189863 | A1 | 8/2011 | Sare et al. | |
| 2012/0021618 | A1 | 1/2012 | Schultz | |
| 2012/0071008 | A1 * | 3/2012 | Sessford | H01R 13/6205 439/39 |
| 2012/0077352 | A1 * | 3/2012 | Weyer | H01R 13/6205 439/39 |
| 2012/0143062 | A1 * | 6/2012 | Nordgren | H01R 13/6205 439/39 |
| 2012/0178270 | A1 * | 7/2012 | McElroy | H01R 13/22 439/39 |
| 2012/0252231 | A1 * | 10/2012 | Kall | H01R 13/6205 439/39 |
| 2013/0143419 | A1 * | 6/2013 | Wei | G06F 1/1626 439/39 |
| 2013/0189855 | A1 * | 7/2013 | Lai | H01R 11/30 439/39 |

FOREIGN PATENT DOCUMENTS

| | | | |
|---|---|---|---|
| KR | 10-2011-0065543 | A | 6/2011 |
| WO | WO-2007/037807 | A1 | 4/2007 |
| WO | WO-2011150402 | | 12/2011 |

OTHER PUBLICATIONS

Michaluk, K.; "Blackberry Playbook Chargers"; May 16, 2011: 13 pages.

* cited by examiner

MAGNETIC CONNECTOR FOR A COMPUTING DEVICE

BACKGROUND OF THE INVENTION

Computing devices typically require physical connectors for connecting the devices to a power cord or to other devices. Depending on the manufacturer, many devices typically require a male-to-female connecting mechanism, such as a universal serial bus (USB) or micro-USB connector, in order to exchange power or data with other devices.

DETAILED DESCRIPTION

Embodiments described herein provide for a magnetic connector having a keying feature to facilitate proper coupling of the magnetic connector to a corresponding or opposing connector. The magnetic connector can be used with various types of computing devices.

According to embodiments, the magnetic connector can include a housing that has an asymmetric orientation. The asymmetric orientation can provide a visual feature to assist the user to properly align the magnetic connector with the opposing connector. The magnetic connector can include a connector interface that has a similar shape as the housing of the magnetic connector and that has one or more contact elements for carrying at least one of a data signal or a power signal. When the magnetic connector is properly aligned and mated with the opposing connector, data or power can be transferred or exchanged via the mated connectors.

The magnetic connector can include one or more magnetic components that are provided on the connector interface. In one embodiment, the magnetic connector can include two magnetic components, such as a north polarity magnet and a south polarity magnet that are provided on the face of the connector interface. The housing of the magnetic connector, and the two magnetic components can be oriented to key the connector interface into properly alignment when mated with the opposing connector.

In some embodiments, the magnetic connector can be coupled to or be provided as part of a terminal end of a cable, while the opposing connector can be coupled to or be extended from a circuit board of a computing device. In alternative embodiments, the magnetic connector can be coupled to or be extended from the circuit board of the computing device, while the opposing connector can be coupled to or be provided as part of the terminal end of the cable.

As described herein, an asymmetric orientation is an orientation in which there is a single axis of symmetry or no axis of symmetry. In one embodiment, the housing of the magnetic connector can have an asymmetric orientation by having a D-shaped housing. The connector interface of the magnetic connector can also have a similar shaped housing.

Some embodiments described herein can generally require the use of computing devices, including processing and memory resources. For example, one or more embodiments described herein may be implemented, in whole or in part, on computing devices such as desktop computers, cellular or smart phones, personal digital assistants (PDAs), laptop computers, printers, digital picture frames, and tablet devices.

Figure 1A:
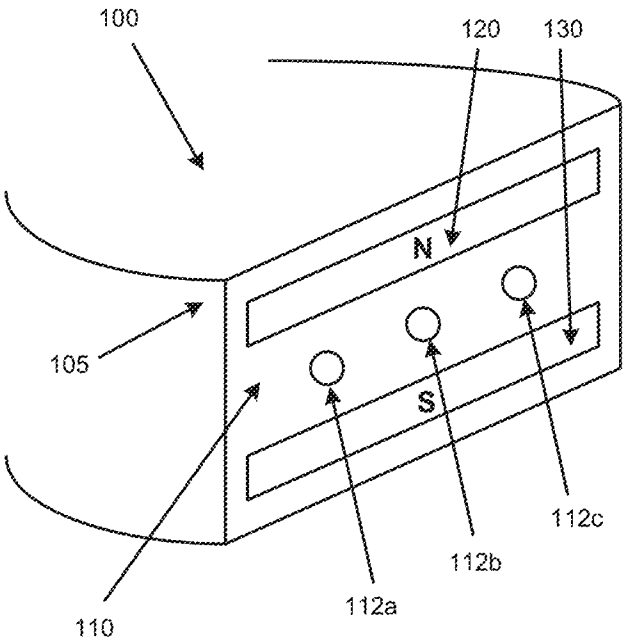
FIGS. 1A-1D illustrate an example magnetic connector for mating with a corresponding connector.

FIGS. 1A-1D illustrate an example magnetic connector for mating with a corresponding connector. In particular, FIG. 1A illustrates a magnetic connector 100 having a keying feature to facilitate proper coupling of the magnetic connector to a corresponding or opposing connector. The magnetic connector 100 includes a housing 105, and a connector interface 110 that is provided with the housing. The connector interface 110 includes one or more contacts 112*a*, 112*b*, 112*c* that are provided on a surface (e.g., face) of the connector interface 110. The magnetic connector 100 also includes at least two magnetic components 120, 130 that each have a polarity to enable magnetic coupling to a respective corresponding magnetic component of a corresponding connector.

For example, the first magnetic component 120 forms a first polarity (e.g., north) magnetic component, and the second magnetic component 130 forms a second (e.g., south) polarity magnetic component. In one example, the first magnetic component 120 can be a magnet having a first polarity (e.g., a north polarity, represented by "N"), and the second magnetic component 130 can be a magnet having a second polarity that is opposite than the first polarity (e.g., a south polarity, represented by "S"). The housing 105, the first magnet 120, and the second magnet 130 are oriented to key the connector interface 110 into proper alignment when mated with an opposing connector.

Figure 1B:
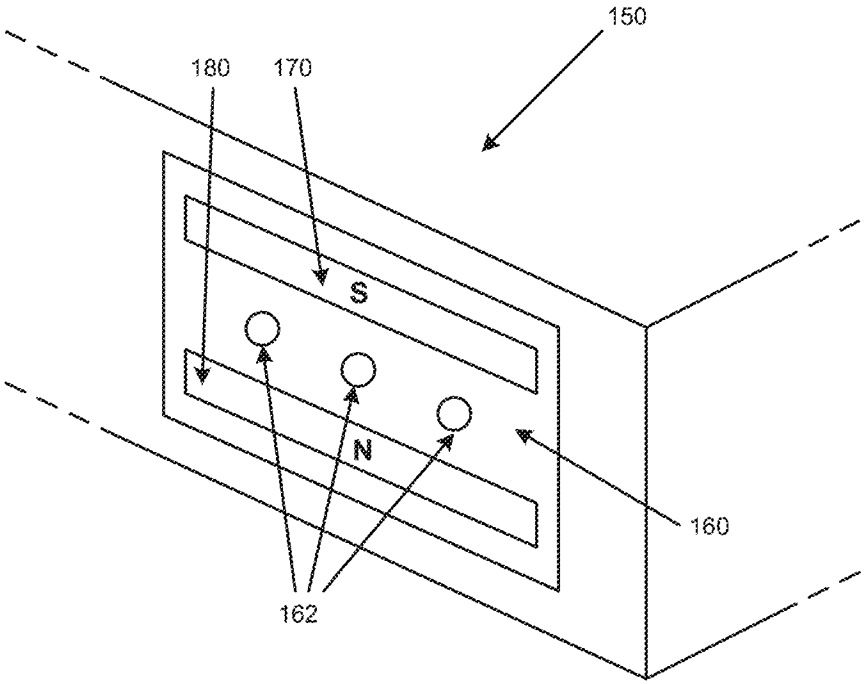

FIG. 1B illustrates the corresponding opposing connector that can mate with the magnetic connector 100, as illustrated in FIG. 1A. The opposing connector 150 can be provided on a surface or with a housing of a computing device. The opposing connector 150 includes similar features to that of the magnetic connector 100. For example, the opposing connector 150 can have a connector interface 160 that is a similar shape and/or size (e.g., rectangular or asymmetrical) to that of the connector interface 110 of the magnetic connector 100. The connector interface 160 of the opposing connector 150 can include one or more contacts 162 that are arranged to properly align and contact the one or more contacts 112 of the magnetic connector 100 when the connectors are properly aligned and mated.

Figure 1C:
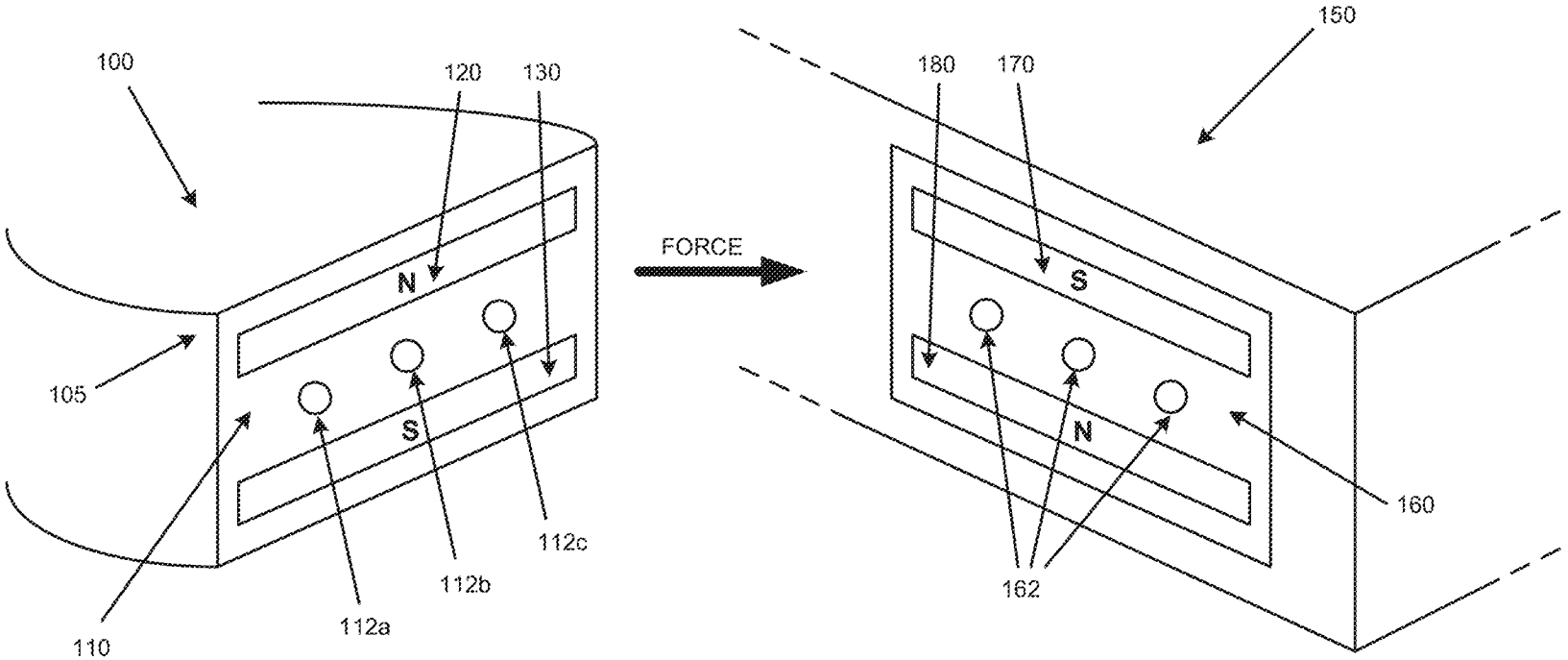

In some implementations, the connector interface 160 of the opposing connector 150 can also include one or more magnetic components. For example, the connector interface 160 can include a first magnetic component (e.g., magnet 170) and a second magnetic component (e.g., magnet 180). The first magnet 170 can have a polarity to enable the first magnet 120 of the magnetic connector 100 to magnetically couple to the first magnet 170 of the opposing connector 150 (e.g., have a south polarity), and the second magnet 180 can have a polarity to enable the second magnet 130 of the magnetic connector 100 to magnetically couple to the second magnet 180 of the opposing connector 150 (e.g., have a north polarity). In this manner, when the user attempts to connect the magnetic connector 100 to the opposing connector 150) in the proper alignment (e.g., brings the magnetic connector 100 to a sufficient magnetic proximity to the opposing connector 150), as illustrated in FIG. 1C, a resulting magnetic attraction force guides the magnetic connector 100 into properly mating with the opposing connector 150 (e.g., align the contacts 112, 162 properly).

The arrangement of the magnets 120, 130 on the magnetic connector 120 and the magnets 170, 180 on the opposing connector 150 guide the connectors into proper alignment when mated. This prevents electrical shorting of the computing device or other unwanted effects from misaligning the connectors. The magnetic connector 100 can include three contacts 112, such as a VBUS (or +), a detect, and/or a GND (or −), that are aligned together in one embodiment. For example, contact 112*a* can correspond to VBUS, contact 112*b* can correspond to detect, and contact 112*c* can correspond to GND. In variations, other arrangements can be possible, such as asymmetrically aligned or aligned in a triangle. By enabling the connectors to only mate together in the proper alignment, power can be provided from the magnetic connector 100, for example, via the VBUS pin, and power can be properly received by the correct pin on the opposing connector 150.

According to other examples, additional contacts 112 can be provided on the connector interface 110 for transferring power and/or data via the magnetic connector 110. In variations, the VBUS contact and the GND contact can be a DATA+ and a DATA− contact, respectively, or additional contacts for a DATA+ and a DATA− contact can be provided on the connector interface 110.

Figure 1D:
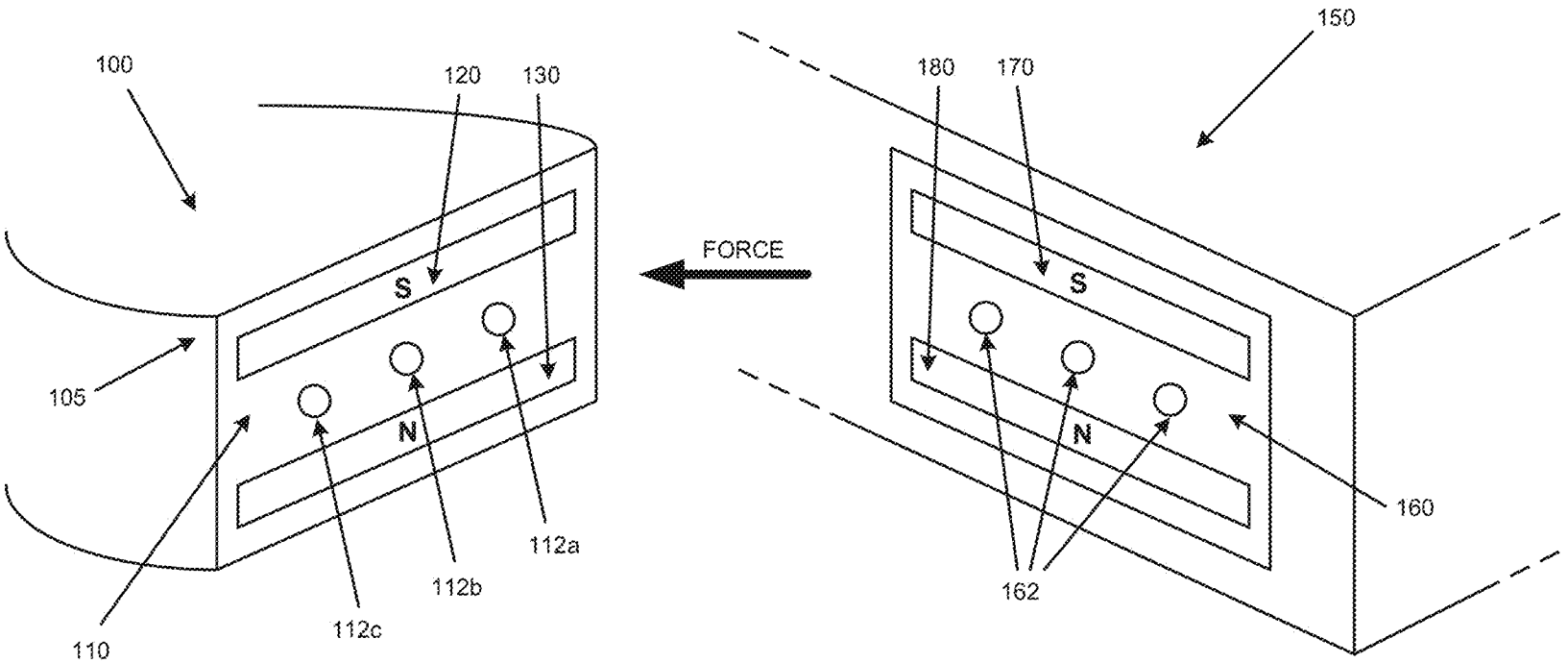

FIG. 1D illustrates an example magnetic connector when improperly aligned with the opposing connector 150. In FIG. 1D, the magnetic connector 100 has been flipped or rotated by 180 degrees. When the user attempts to connect the magnetic connector 100 with the opposing connector 150, the magnet 130 (which has a south polarity) is aligned with the magnet 170 (which also has a south polarity). Similarly, the magnet 120, which has a north polarity, is aligned with the magnet 180, which has a north polarity. As a result, when the user brings the connectors 100, 150 closer together in an improper alignment, a magnetic repelling force prevents the connectors 100, 150 from coupling together. Because of the magnetic repelling force created by both sets of magnets, user-error such as dual orientation coupling by the magnetic connector 100 can be avoided.

The magnetically keying feature of the magnetic connector 100 facilitates proper coupling of the magnetic connector 100 to a corresponding or opposing connector. In addition, because the magnetic connector 100 includes a magnetically keying feature, improper and/or misaligned connections can be prevented.

Although examples provide the use of two magnetic components that are provided on the connector 100, and two magnetic components that are provided on the corresponding connector 150, in variations, the connector 100 can have a single magnetic component. For example, referring back to FIG. 1D, connector 100 can include just the first magnetic component 120 so that when the connectors 100, 150 are brought closer together in an improper alignment, a magnetic repelling force still prevents the connectors 100, 150 from coupling together. Similarly, referring to FIG. 1C, the first magnetic component 120 aligning with the first magnetic component 170 results in a magnetic attraction force to guide the magnetic connector 100 into properly mating with the opposing connector 150 even without the second magnetic component 130.

Figure 2:
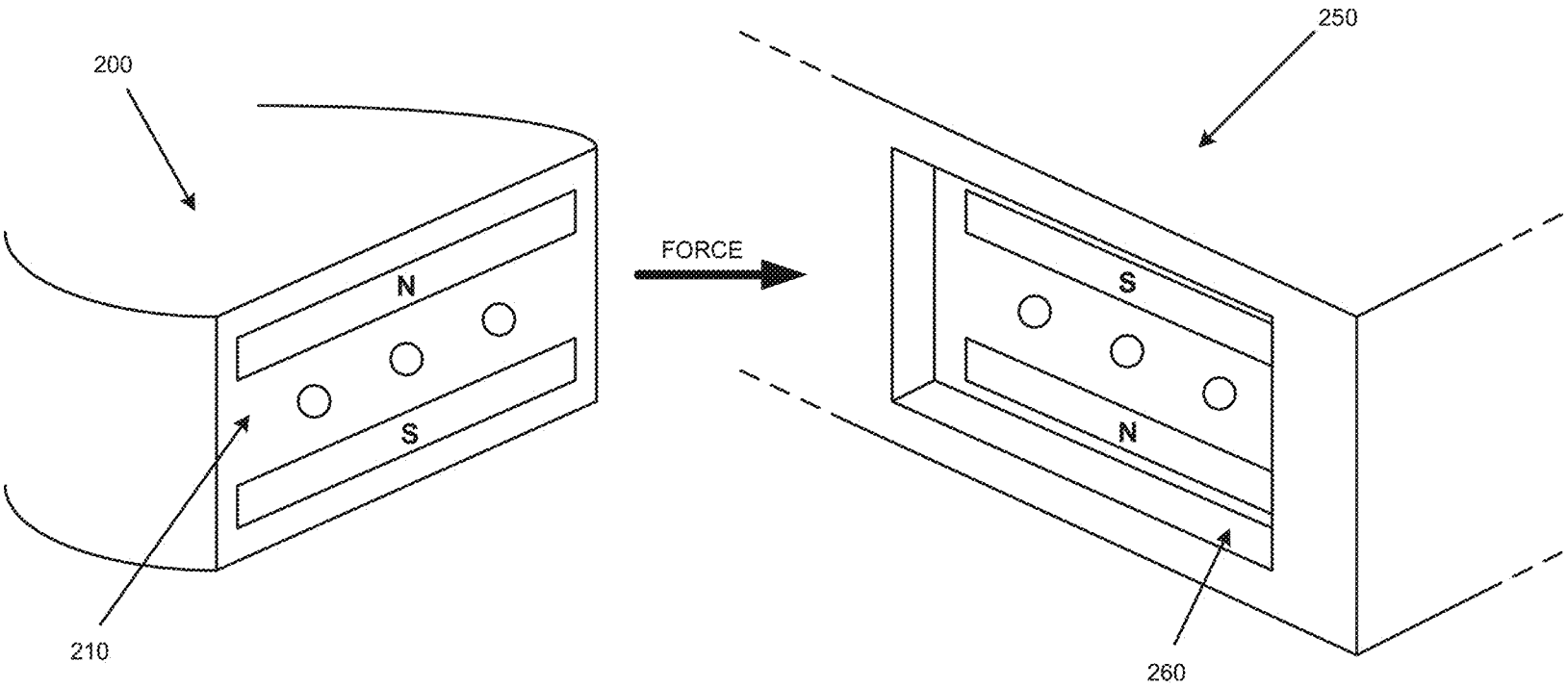
FIG. 2 illustrates an example magnetic connector for mating with a corresponding connector.

FIG. 2 illustrates an example magnetic connector for mating with a corresponding connector. In the example provided in FIG. 2, the opposing connector 250 is provided with a housing of a computing device so that the magnetic connector 200 can be inserted into a portion of the housing. The opening 260 of the housing where the opposing connector 250 is positioned in can have a similar shape as the housing and/or the connector interface 210 of the magnetic connector 200.

In addition, in FIG. 2, the magnets of the magnetic connector 200 are properly aligned with the magnetic of the opposing connector 250 so that when the user brings the magnetic connector 200 to a sufficient proximity to the opposing connector 250, an attraction force can enable the magnetic connector 200 to automatically and properly mate with the opposing connector 250. The opening can provide an additional retaining mechanism for maintaining the connection between the connectors 200, 250.

Figure 3:
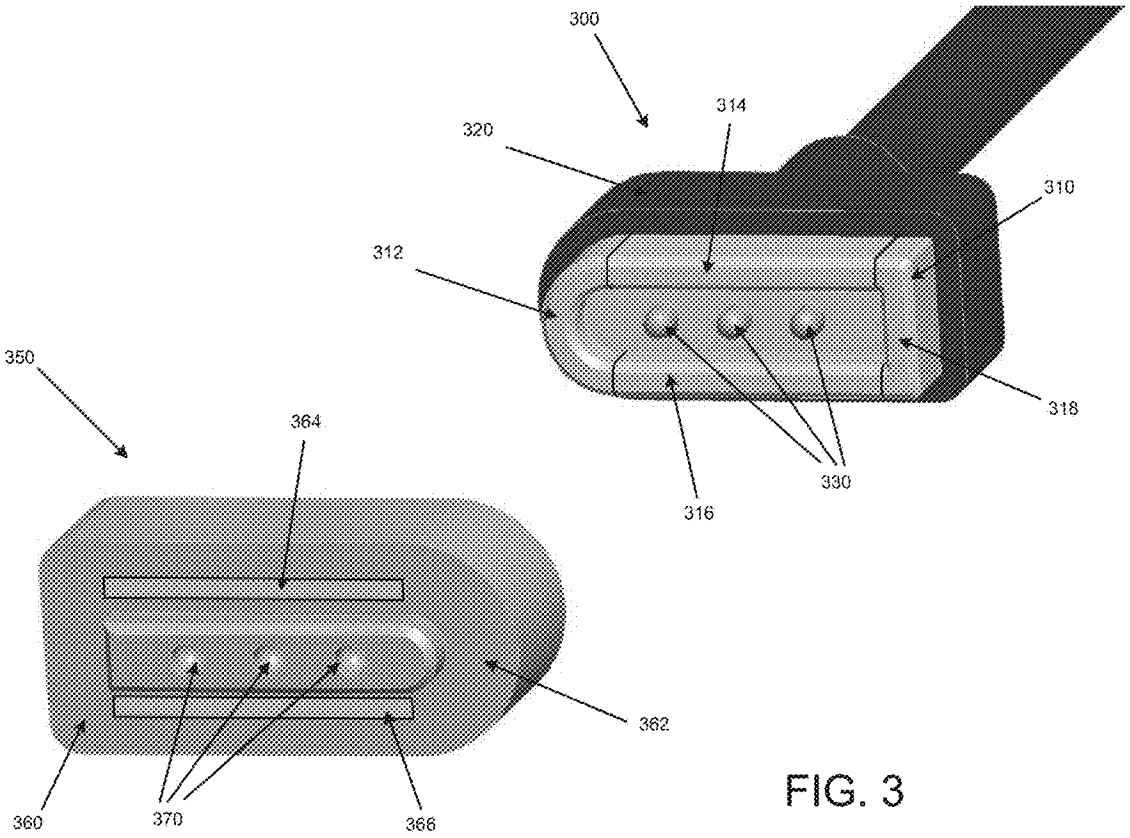
FIG. 3 illustrates an example magnetic connector for mating with a corresponding connector.

FIG. 3 illustrates an example magnetic connector for mating with a corresponding connector. Magnetic connector 300 includes a connector interface 310 provided on a housing 320. The connector interface 310 and the housing 320 are in an asymmetrical orientation, such as a D-shape, as illustrated in FIG. 3. The D-shape housing 320 provides a user with a visual feature to assist the user in properly aligning the magnetic connector 300 with the opposing connector 350. The connector interface 310 also includes a first magnet 314 having a first polarity (e.g., a north polarity), a second magnet 316 having a second polarity that is opposite the first polarity (e.g., a south polarity), and non-magnetic material 312, 318.

The connector interface 310 also includes one or more contact elements 330. The one or more contact elements 330 can include a VBUS (or +) pin, a detect pin, and a GND (or −) pin. The one or more contact elements 330 can also be spring loaded pogo pins. The detect pin can enable power transfer, for example, when it detects that it is properly coupled to a detect pin of a corresponding connector.

The corresponding opposing connector 350 can include a first magnet 364 having a south polarity, and a second magnet 366 having a north polarity. The connector interface 360 can also include non-magnetic material 362 and one or more contact elements 370 for exchanging, receiving, or transferring at least one of a power signal or a data signal. Like the connector interface 310 of the magnetic connector 300, the connector interface 360 can also have a similar asymmetric shape, for mating with the connector interface 310 of the magnetic connector 300.

When the magnetic connector 300 and the opposing connector 350 are properly aligned and mated, the first magnet 314 of the magnetic connector 300 (which has a north polarity) is magnetically attracted to the first magnet 364 of the opposing connector 350 (which has a south polarity). Similarly, the second magnet 316 of the magnetic connector 300 (which has a south polarity) is magnetically attracted to the second magnet 366 of the opposing connector 350 (which has a north polarity). In this manner, when the connectors 300, 350 are properly aligned and mated, the contact elements 330 of the magnetic connector 300 can be properly connected to the contact elements 370 of the opposing connector 350.

In some examples, in order for a user to properly align the magnetic connector 300 with the opposing connector 350, the shape of the connector interface 310 must match the shape of the connector interface 360 of the opposing connector 350. The asymmetric shape of the housing 320 provides the user with a visual guide so that the user can see if the magnetic connector 300 is being properly coupled. At the same time, when the shapes of the connector interfaces 310, 360 are not properly aligned, a magnetic repelling force will also prevent the user from coupling the connectors 300, 350 together (e.g., when the shapes are not aligned, the north polarity magnets are being aligned with each other and the south polarity magnets are being aligned with each other).

Figure 4B:
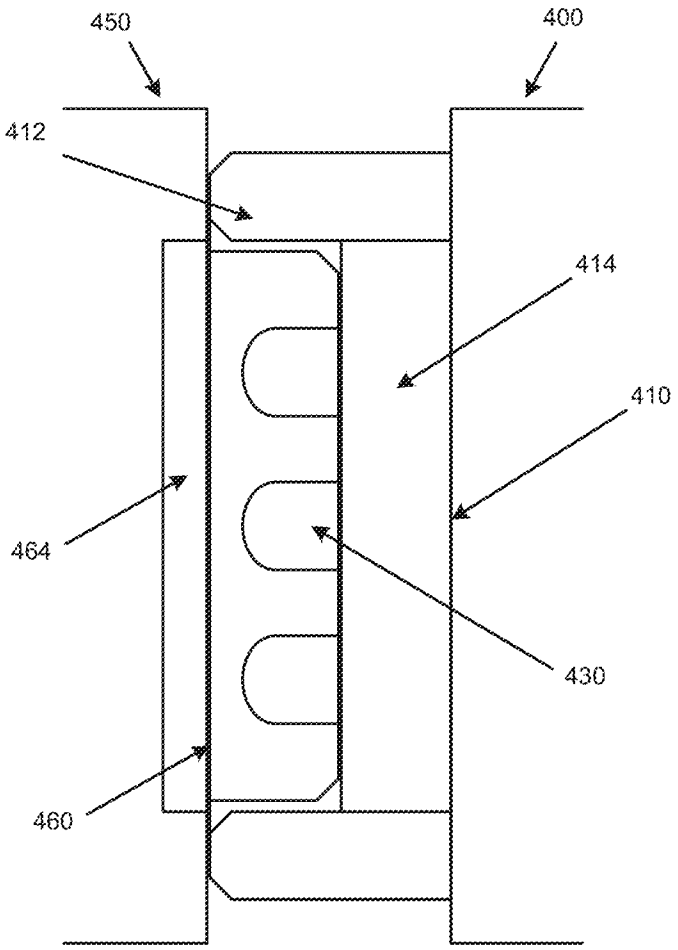
FIGS. 4A-4B illustrate example cross-sectional views of a magnetic connector that is properly mated with a corresponding connector.
Figure 4A:
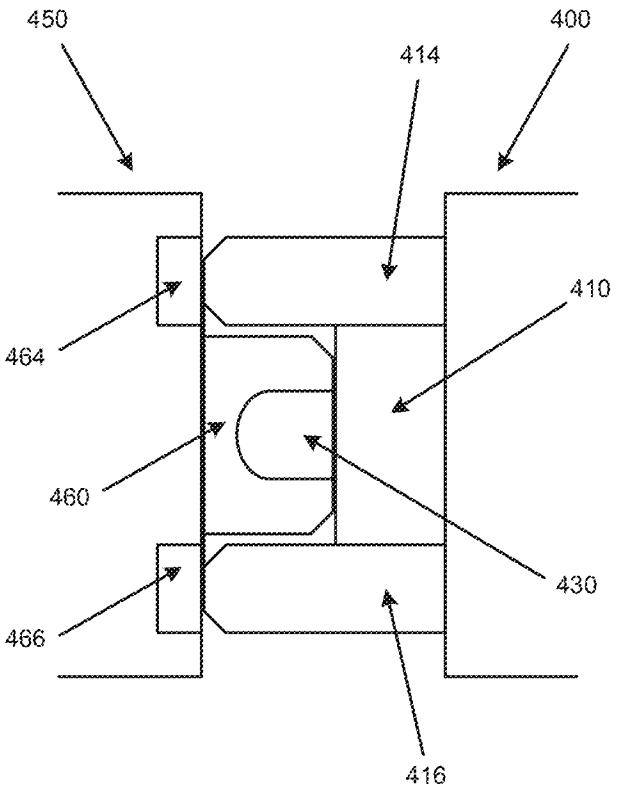

FIGS. 4A-4B illustrate example cross-sectional views of a magnetic connector that is properly mated with a corresponding connector. FIG. 4A illustrates an example side cross-section view of a magnetic connector 400 that is properly mated with an opposing connector 450. FIG. 4B illustrates an example top cross-section view of the magnetic connector 400 that is properly mated with the opposing connector 450. According to variations, the magnetic connector 400 can be provided on a terminal end of a cable (e.g., such as a cable coupled to a plug), while the opposing connector 450 is provided with a computing device. Alternatively, the magnetic connector 400 can be provided with a computing device, while the opposing connector 450 is provided on a terminal end of a cable.

When the connectors 400, 450 are properly mated, the first magnet 414 of the magnetic connector 400 having a first polarity (e.g., a north polarity) is magnetically coupled to the first magnet 464 of the opposing connector 450 having a second polarity (e.g., a south polarity). Similarly, the second magnet 416 (e.g., having a south polarity) is magnetically coupled to the second magnet 466 of the opposing connector 450 (e.g., having a north polarity). The magnets 414, 464, 416, 466 properly align the connector interfaces 410, 460 so that the contact elements 430 of the magnetic connector 400 properly align with the contact elements of the opposing connector 450. The non-magnetic material 412 can provide shaping of the connector interface 410 so that the connector interface 410 can also physically engage with the connector interface 460 of the opposing connector 450.

Figure 5B:
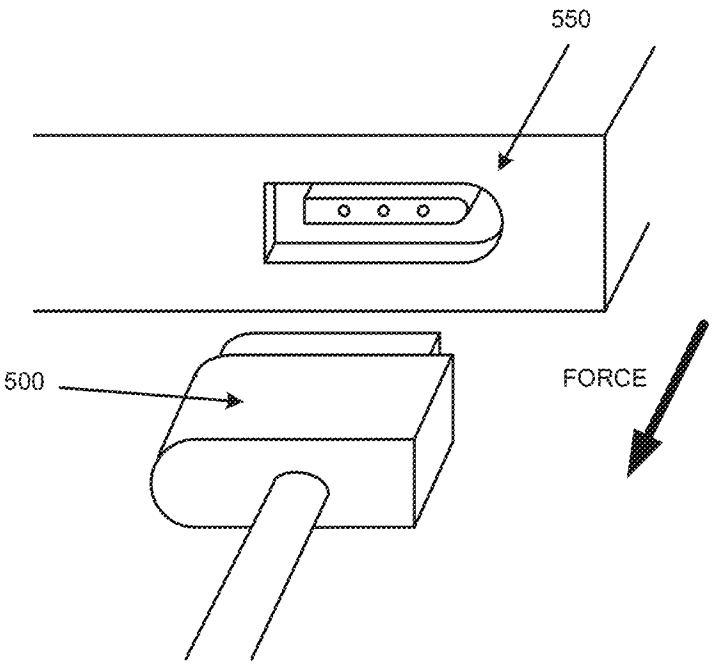
FIGS. 5A-5B illustrate example scenarios of proper alignment versus improper alignment of a magnetic connector and a corresponding connector.
Figure 5A:
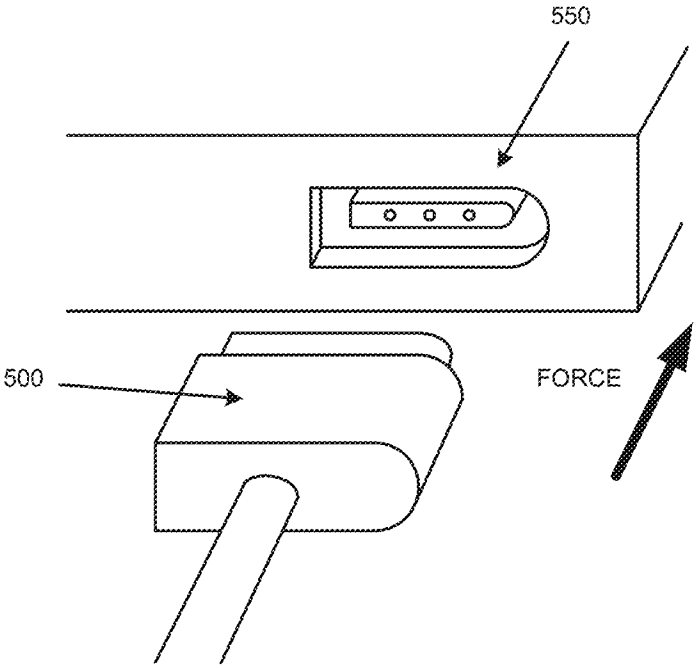

FIGS. 5A-5B illustrate example scenarios of proper alignment versus improper alignment of a magnetic connector and a corresponding connector. In particular, the examples provided in FIGS. 5A-5B illustrate the housing of the magnetic connector 500 being in an asymmetric shape (e.g., a D-shape) to provide a visual feedback or feature for the user when the user attempts to connect the magnetic connector 500 with the opposing connector 550. For example, the housing of the device can include an opening that has a similar shape as the housing of the magnetic connector 500. This enables the magnetic connector 500 to be only inserted into the opening in a particular direction. In addition, the arrangement of the magnets of the magnetic connector 500 and the opposing connector 550 provide a magnetic force to assist in connecting the connectors 500, 550 when properly aligned, as well as preclude or guide against connection when not properly aligned.

For example, in FIG. 5A, when the user brings the magnetic connector 500 into sufficient magnetic proximity to the opposing connector 550, the user can feel the magnetic attractive force that is created between the connectors 500, 550. Thus, the magnetic connectors provide tactile feedback for the user that an alignment is correct. In one example, when the magnetic connector 500 is brought into sufficient magnetic proximity to the opposing connector 550, the magnetic attractive force can cause the magnetic connector 500 to couple to the opposing connector 550.

FIG. 5B shows that when the magnetic connector 500 is in proximity to the opposing connector 550 with improper alignment the user receives tactile feedback of the misalignment (e.g., as a result of the magnetic repelling force that is created between the connectors 500, 550). In some examples, the magnetic repelling force can help rotate the magnetic connector 500 to the proper arrangement until the connectors 500, 550 (and the magnets of the respective connectors 500, 500) are properly aligned.

Figure 6A:
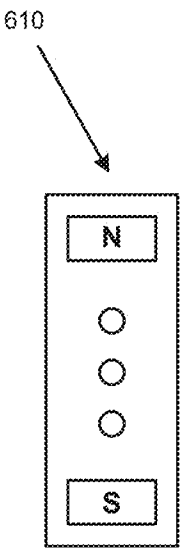
FIGS. 6A-6D illustrate example magnetic connectors.

FIGS. 6A-6D illustrate example magnetic connectors. FIG. 6A illustrates a connector interface for a magnetic connector 610 having a symmetric orientation. However, as opposed to the connectors illustrated in FIGS. 1A-5B, the magnets are provided on different regions on the face of the connector interface. For example, instead of a pair of elongate rectangular magnets, the two magnets on the magnetic connector 610 are smaller, less elongate magnets that are provided on opposing sides of the contact elements and are aligned with the contact elements.

Figure 6B:
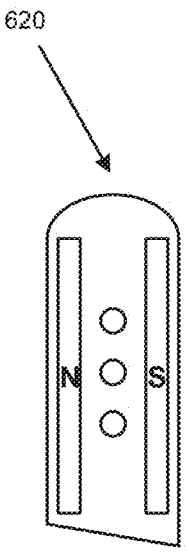

FIG. 6B illustrates an example connector interface for a magnetic connector 620 having an asymmetric orientation, and with no axis of symmetry. Such an asymmetric orientation can provide a mechanical keying feature that enables proper alignment when the connectors are mated. In addition to the shaping of the magnetic connector 620, the magnets provided on the connector interface can also provide a magnetic attraction/repulsion force depending on whether alignment is present.

Figure 6C:
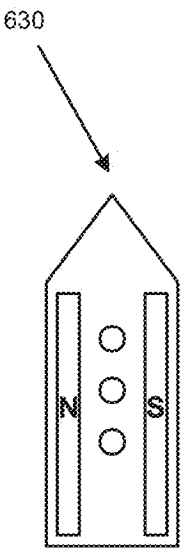
Figure 6D:
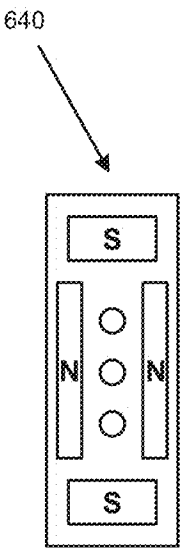

FIG. 6C illustrates an example connector interface for a magnetic connector 630 having an asymmetric orientation, where there is a single axis of symmetry. Such a connector interface can be similar to the D-shaped connector interface as described in FIGS. 3-5B. FIG. 6D illustrates an example connector interface for a magnetic connector 640 having four magnets instead of two. In other examples, more than four magnets can be provided with the magnetic connector 640 and the corresponding opposing connector. Having additional magnets can enable a stronger magnetic attraction force or a stronger magnetic repelling force.

It is contemplated for embodiments described herein to extend to individual elements and concepts described herein, independently of other concepts, ideas or system, as well as for embodiments to include combinations of elements recited anywhere in this application. Although embodiments are described in detail herein with reference to the accompanying drawings, it is to be understood that the invention is not limited to those precise embodiments. As such, many modifications and variations will be apparent to practitioners skilled in this art. Accordingly, it is intended that the scope of the invention be defined by the following claims and their equivalents. Furthermore, it is contemplated that a particular feature described either individually or as part of an embodiment can be combined with other individually described features, or parts of other embodiments, even if the other features and embodiments make no mentioned of the particular feature. Thus, the absence of describing combinations should not preclude the inventor from claiming rights to such combinations.

What is claimed is:

1. A magnetic connector for a computing device, the magnetic connector comprising:

a housing including an asymmetric D-shape;

a connector interface including at least one contact element to carry at least one of a data signal or a power signal;

a first magnetic component having a first polarity provided on the connector interface and a second magnetic component having a second polarity provided on the connector interface, the first and second magnetic components extending from the connector interface, past the contact element to define a recess around the contact element; and wherein the housing and the first and second magnetic components are oriented to key the connector interface into proper alignment when mated with an opposing connector having a housing with a complementary asymmetric D-shape, the opposing connector including at least two magnetic components of opposite polarity to engage with the first and second magnetic components, and a complementary contact element, the recess to receive the complementary contact element.

2. The magnetic connector of claim 1, wherein the connector interface includes less than four contact elements to transmit at least one of ground, power, or data.

3. The magnetic connector of claim 1, wherein the connector interface includes non-magnetic material.

4. The magnetic connector of claim 1, wherein the magnetic connector is extended from a circuit board to receive the opposing connector provided on a terminal end of a cable.

5. The magnetic connector of claim 1, wherein the magnetic component is provided on a face of the connector interface.

6. The magnetic connector of claim 5, wherein the connector interface includes only three contact elements.

7. The magnetic connector of claim 1, wherein the magnetic connector is provided on a terminal end of a cable to mate with the opposing connector provided on a device.

8. The magnetic connector of claim 7, wherein the at least one contact element of the connector interface is a pogo-style contact element.

9. A connector assembly comprising:

a first connector comprising:

a first housing including a first asymmetric D-shape;

a first connector interface including at least one contact element to carry at least one of a data signal or a power signal;

a first magnetic component provided on the connector interface; and a second magnetic component provided on the connector interface, the first and second magnetic components extending from the connector interface and past the contact element so as to define a recess around the contact element; and a second connector comprising:

a second housing including a second asymmetric D-shape that is capable of being mated with the first housing of the first connector;

a second connector interface including at least one contact element, the second connector interface being oriented to align with the first connector interface when the first and second housing are mated, the second contact element extending from the second connector interface;

a first magnetic component provided on the second connector interface to mate with the first magnetic component provided on the first connector interface of the first connector and to magnetically repel the second magnetic component provided on the first connector interface of the first connector; and a second magnetic component having an opposite polarity to the first magnetic component, the second contact element to extend past the first and second magnetic components to be received by the recess when the first and second housing are mated.

10. The connector system of claim 9, wherein one of the first or second connector is provided on a terminal end of a cable, and the other of the first or second connector is extended from a circuit board of a computing device.

11. The connector system of claim 9, wherein the first connector interface and the second connector interface each include non-magnetic material.

12. The connector system of claim 9, wherein the first connector interface and the second connector interface each include only three contact elements to carry at least one of ground, power, or data.

13. A computing device comprising:

a magnetic connector including:

a housing including an asymmetric D-shape;

a connector interface including at least one contact element to carry at least one of a data signal or a power signal;

a first and second magnetic component provided on the connector interface, each having an opposite polarity and extending from the connector interface and past the contact element to define a recess; and wherein the housing, and the magnetic components are oriented to key the connector interface into proper alignment when mated with an opposing connector having a housing including a complementary asymmetric D-shape, the opposing connector including at least two magnetic components of opposite polarity and a complementary contact element extending past the two magnetic components to be received by the recess of the connector.

* * * * *